US005815780A

United States Patent [19]

Boerger

[11] Patent Number: 5,815,780

[45] Date of Patent: Sep. 29, 1998

[54] METHOD AND APPARATUS FOR STORING AND DELIVERING TONER

[75] Inventor: Richard H. Boerger, Rochester, N.Y.

[73] Assignee: Xerox Corporation, Stamford, Conn.

[21] Appl. No.: 772,366

[22] Filed: Dec. 23, 1996

[51] Int. Cl.[6] ..... G03G 15/08

[52] U.S. Cl. ..... 399/260; 399/262

[58] Field of Search ..... 399/258, 260, 399/262; 222/DIG. 1, 81, 160

[56] References Cited

U.S. PATENT DOCUMENTS

| | | | |
|---|---|---|---|
| 3,059,815 | 10/1962 | Parsons, Jr. | 222/81 |
| 3,599,682 | 8/1971 | Altmann | 222/81 |
| 4,301,923 | 11/1981 | Vuorento | 206/484 |
| 4,349,132 | 9/1982 | Macaluso | 222/DIG. 1 |
| 4,417,802 | 11/1983 | Forbes, II . | |
| 4,647,180 | 3/1987 | Watanabe . | |
| 4,766,457 | 8/1988 | Barker et al. | 399/106 |
| 4,919,071 | 4/1990 | Gatti | 399/111 |
| 5,075,727 | 12/1991 | Nakatomi . | |
| 5,079,591 | 1/1992 | Tomita et al. . | |
| 5,412,364 | 5/1995 | Iguchi et al. | 399/262 |
| 5,517,288 | 5/1996 | Martin et al. . | |

FOREIGN PATENT DOCUMENTS

| | | |
|---|---|---|
| 4-42179 | 2/1992 | Japan . |

*Primary Examiner*—Robert Beatty

[57] ABSTRACT

A method and apparatus for delivering toner in sealed containers to a developing system in an electrophotographic machine. Toner is sealed in flexible containers which are connected in a belt-like manner so that toner can be supplied continuously in discrete amounts to the developing system. The belt of sealed toner containers travel from a toner supply housing to an extractor unit where the containers are opened, allowing the toner contained therein to fall to the developing system. The depleted toner containers continue to travel to a take-up member where they are stored. Generally, the depleted toner containers are removed from the take-up member and discarded when a new supply of toner is added to the toner supply housing. This sealed container system allows for a large supply of toner to be stored anywhere in the electrophotographic machine and for the toner supply to be replaced very cleanly.

14 Claims, 2 Drawing Sheets

METHOD AND APPARATUS FOR STORING AND DELIVERING TONER

This invention relates generally to the storage and delivery of toner to a developing system, and more particularly concerns storing the toner in a plurality of sealed containers and delivering the toner in discrete amounts to the developing system.

In a typical electrophotographic printing process, a photoconductive member is charged to substantially uniform potential so as to sensitize the surface thereof. The charged portion of the photconductive member is exposed to an image of an original document being reproduced. Exposure of the charged photoconductive member selectively dissipates the charges thereon in the imaged areas. This records an electrostatic latent image on the photoconductive member corresponding to the information areas contained within the original document. After the electrostatic latent image is recorded on the photoconductive member, the latent image is developed by bringing a developer material into contact therewith. Generally, the developer material comprises toner particles adhering triboelectrically to carrier particles. The toner particles are attracted from the carrier particles to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

In many of the machines described above, powder toner is contained in a removable container which mates with the developer housing to supply toner to the developer housing for mixing with the carrier. Typically, the toner container is some sort of cartridge which allows the toner to feed into the developer housing due to the force of gravity. This gravitational force necessitates that the containers be configured vertically to the developer housing inlet to allow the toner to fall into the housing or else requires that an additional toner moving mechanism for moving the toner to the developer housing. Another limitation of current toner supply systems is that the amount of toner stored in a container is limited due to the properties of toner. When a large amount of toner is stored in a container, the toner compacts due to its weight and the compacted toner is difficult to separate for developing purposes. Also, when the toner container is unsealed, the toner inside the container is exposed to environmental conditions, such as humidity, which undesirably affect the flow and developing characteristics of the toner. It is desirable to have a toner supply system which allows for a large supply of toner to be stored therein, while maintaining optimum toner developing characteristics.

The following disclosures may be relevant to various aspects of the present invention:

U.S. Pat. No. 4,417,802
Inventor: Forbes
Issued: Nov. 29, 1983
U.S. Pat. No. 4,647,180
Inventor: Watanabe
Issued: Mar. 3, 1987
U.S. Pat. No. 5,075,727
Inventor: Nakatomi
Issued: Dec. 24, 1991
U.S. Pat. No. 5,079,591
Inventor: Tomita et al.
Issued: Jan. 7, 1992
U.S. Pat. No. 5,517,288
Inventor: Martin et al.
Issued: May. 14, 1996
U.S. Pat. No. 4,301,923
Inventor: Vuorento Issued: Nov. 24, 1981

Some relevant portions of the foregoing disclosures may be briefly summarized as follows:

U.S. Pat. No. 4,417,802 teaches an apparatus which dispenses toner particles into the chamber of a housing storing developer material. The toner particles are stored in a container and dispensed from the uppermost portion thereof. A conveyor belt coveys toner in discrete amounts from the container to the chamber.

U.S. Pat. No. 4,647,180 discloses a developing device constructed so that a developing agent resupply section is located side by side with a developing chamber. A feed member for feeding a developing agent into the developing chamber is disposed in the developing agent resupply section. The feed member includes a film which encases the toner, the film being attached to a take up shaft which causes the film to lift the toner up so that the toner can be supplied to the developing chamber.

U.S. Pat. No. 5,075,727 teaches a developing device with a removably mounted casing and a storing chamber in which developer is to be supplied. A package sealing developer is located in the storing chamber. After the device is attached to the developer housing, the package is opened by an opening mechanism so as to supply the developer in the package into the storing chamber.

U.S. Pat. No. 5,079,591 describes a developing apparatus operable with a toner cartridge having a flexible sack which is filled with toner. When the toner cartridge is mounted on a developing tank, the sack having been held under tension by the toner is perforated to from a hole therein. The hole causes the sack to contract rapidly due to its contactability while forcing the toner out of the sack. The toner is dropped or otherwise automatically supplied into the developing tank.

U.S. Pat. No. 5,517,288 teaches an apparatus for creating powder images. An image forming member and a toner delivery system are supported opposite to each other. The images are formed by the image forming member along a first directions. The toner delivery system includes a toner transport for moving toner particles from a supply zone opposite the image forming member. The toner transport is an endless belt which delivers discreet amounts of toner to the developing nip.

U.S. Pat. No. 4,301,923 discloses a disposable portion package comprising a casing made of a flexible film, which tightly encloses the packaged substance and also a certain amount of air or some other gas. The package has a conduit which is arranged to open by means of pressure produced inside the package.

All of the above references are hereby incorporated by reference.

SUMMARY OF THE INVENTION

One aspect of the invention is drawn to a method for storing and delivering toner to a developing system in a printing device including sealing toner in a plurality of flexible containers and connecting the plurality of containers with connecting members in a belt-like fashion. This configuration allows toner to be delivered to the developing system in continuous discrete amounts.

Another aspect of the invention is drawn to a method for storing and delivering toner to a developing system in a printing device including storing toner in sealed containers which are connected by a connecting member. The sealed containers are placed a toner supply housing and toner is extracted from the containers by rupturing the containers so that the extracted toner is delivered to the developing system.

Yet another aspect of the invention is drawn to an apparatus for storing and delivering toner to a developing system in an electrophotographic machine including sealed toner containers which are connected with a connecting member and a toner supply housing for storing the containers. An extractor unit extracts toner from the containers and the extracted toner is delivered to the developing system. A controller controls the amount of toner supplied to the extractor unit so that the toner is extracted sequentially from the containers.

Current toner cartridges now in use are limited in volume, have flow problems, are difficult to change and create disposal problems. The present invention is drawn to a belt of toner filled bubbles which replaces the toner cartridge. The belt is transported along a path from a toner supply magazine to an extraction unit where the toner is extracted from the bubbles and added to the developer supply in the developer housing. The depleted belt is taken up and held on a take up spool. The bubbles are sealed and provide air support and thus the toner is isolated from environmental factors such as humidity and protected from compaction. This configuration permits large reserves of toner to be stored anywhere in the electrophotographic machine.

BRIEF DESCRIPTION OF THE DRAWINGS

Other features of the present invention will become apparent as the following description proceeds and upon reference to the drawings, in which.

DETAILED DESCRIPTION OF THE INVENTION

Figure 1:
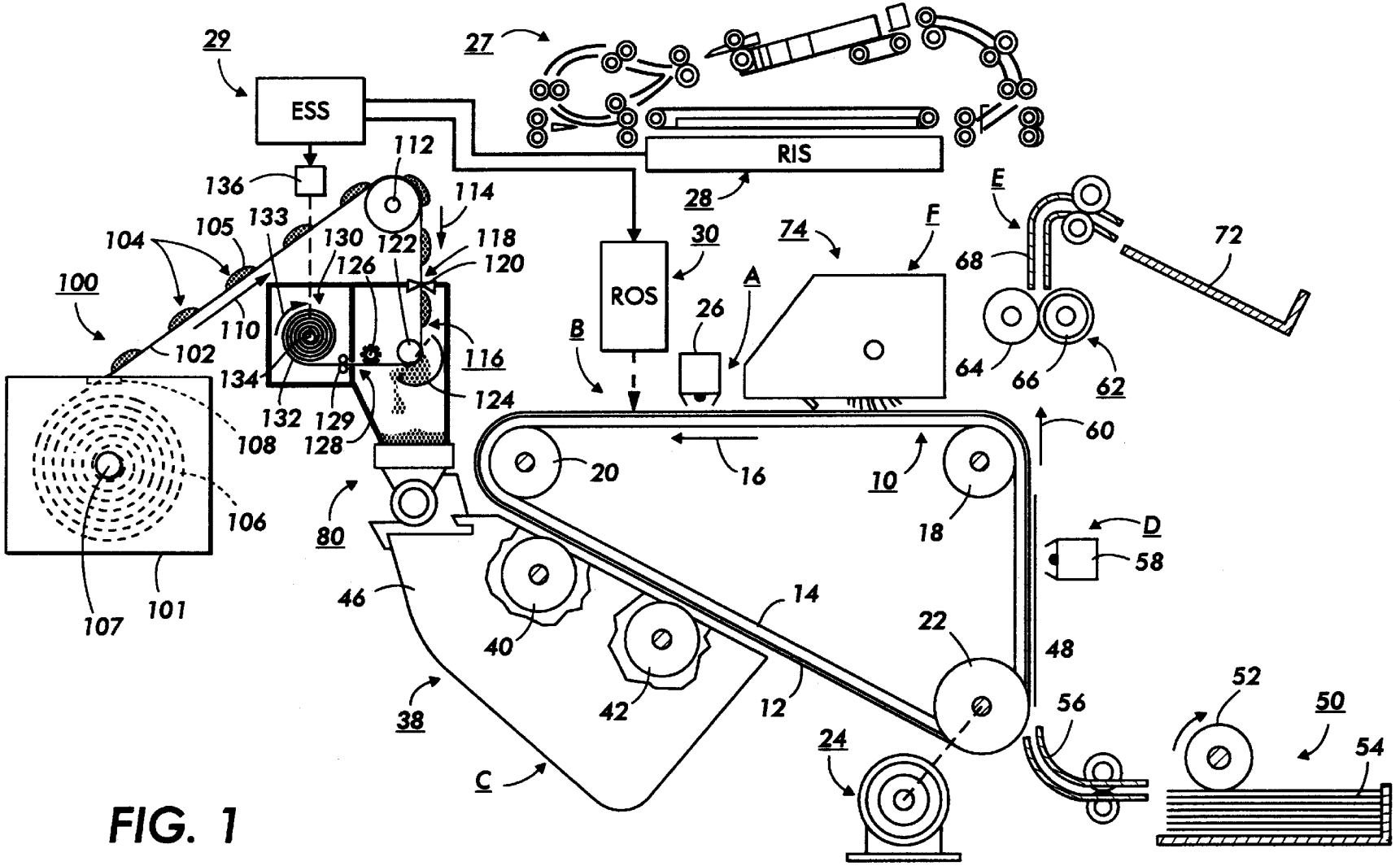
FIG. 1 is a perspective view of the toner bubble supply system used in a first embodiment of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims. For a general understanding of the features of the present invention, reference is made to the drawings. In the drawings, like reference numerals have been used throughout to identify identical elements. FIG. 1 schematically depicts an electrophotographic printing machine incorporating the features of the present invention.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

The printing machine employs a belt 10 having a photoconductive surface 12, deposited on a conductive ground layer 14. Preferably, photoconductive surface 12 is made from a photoresponsive material, for example one comprising a charge generation layer and a transport layer. Conductive layer 14 is preferably made from a thin metal layer or metallized polymer film which is electrically grounded. Belt 10 moves in the direction of arrow 16 to advance successive portions of photconductive surface 12 through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially a portion of belt 10 passes through charging station A. At charging station A corona generating device 26 charges photoconductive surface 12 to a relatively high, substantially uniform potential. After photoconductive surface 12 of belt 10 is charged, the charged portion thereof is advanced through exposure station B.

At exposure station B a controller or electronic subsystem (ESS) 29 receives the image signals representing the desired output image and processes these signals to convert them to a continuous tone or greyscale rendition of the image which is transmitted to a modulated output generator, for example a ROS 30. Preferably ESS 29 is self-contained dedicated minicomputer. The image signals transmitted to ESS 29 may originate from a RIS as described above or from a computer, thereby enabling the electrophotographic printing machine to serve as a remotely located printer for one or more computers.

The signals from ESS 29 are transmitted to ROS 30. ROS 30 includes a laser with rotating polygon mirror blocks. The ROS illuminates the charged portion of photoconductive belt 20 at a resolution of about 300 or more pixels per inch. The ROS will expose the photoconductive belt to record an electrostatic latent image thereon corresponding to the image received from ESS 29.

After the electrostatic latent image has been recorded on photoconductive surface 12, belt 10 advances the latent image to a development station C, where toner in the form of liquid or dry particles is electrostatically attracted to the latent image using commonly known techniques. Preferably, at development station C, a magnetic brush development system 38 advances developer material into contact with the latent image. Magnetic brush development system 38 includes two magnetic brush developer rollers 40 and 42. Rollers 40 and 42 advance developer material into contact with the latent image. These developer rollers form a brush of carrier and toner particles extending outwardly therefrom. The latent image attracts toner particles from the carrier particles forming a toner powder image thereon. As successive electrostatic latent images are developed, toner particles are depleted from the developer material. The developing system includes toner particle dispenser 80, which dispenses toner particles into developer housing 46 of developer unit 38.

With continued reference to FIG. 1, after the electrostatic latent image is developed, the toner powder image present on belt 10 advances to transfer station D. A print sheet 48 is advanced to transfer station D by a sheet feeding apparatus 50. Preferably, sheet feeding apparatus 50 includes a feed roll 52 contacting the uppermost sheet stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

The fusing station E, includes a fuser assembly 62, which permanently affixes the transferred powder image to sheet 48. Fuser assembly 60 includes a heated fuser roller 64 and back-up roller 66 with the toner powder image contacting fuser roller 64. In this manner, the toner powder image is permanently affixed to sheet 48. After fusing, sheet 48 advances through chute 68 again through one or more drive roll idler roll assembly 70 to catch tray 72 for subsequent removal from the printing machine by the operator.

After the print sheet is separated from photoconductive surface 12 of belt 10, the residual toner/developer and paper fiber particles adhering to photoconductive surface 12 are removed therefrom at cleaning station F. Cleaning station F includes a rotatably mounted fibrous brush in contact with photconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for the purposes of the present application to illustrate the general operation of an electrophotographic printing machine incorporating the features of the present invention therein.

Turning now to the toner storage and delivery system 100 of the present invention, a toner supply housing 101 contains a supply of toner stored on a belt 102 in discretely sealed toner bubbles 104 filled with toner 105. The bubbles surrounding the toner may be formed of any flexible material, it being well-known to use plastic film to form sealed bubbles. An amount of air or other gas may be encapsulated in the bubble with the toner to prevent undue compaction of the toner and to aid in the dispersion of the toner when the bubble is ruptured. The belt may include a stiffening substrate such as aluminum or cardboard. In the embodiment shown, the belt 102 is wrapped to form a supply roll 106 on supply roller 107, however the belt may be stored in any other configuration which allows the belt to be easily dispensed through toner supply housing opening 108.

From the supply housing, belt 102 moves in the direction indicated by arrow 110, thereby moving toner bubbles 104 towards the developer housing 80. The belt travels over guide roller 112 which changes the direction of the belt movement as indicated by arrow 114 into extraction housing 116. The extraction housing has an extraction housing entrance 118 which allows belt 102 to enter extraction housing 116. Preferably, extraction housing entrance 118 has a seal 120 which seals the extraction housing so that the extracted toner does not escape from the developing system.

Extraction housing 116 includes an extraction roller 122, which changes the direction of belt movement and properly positions the belt with respect to extractor unit 124. The extractor unit can be any device which causes toner bubble 104 to rupture, allowing the toner 105 within the bubble to escape, for example, a knife slitting the bubble open or applying pressure to the bubble to cause the bubble to rupture or any equivalent bubble opening device. The freed toner falls into developer housing 80 to replenish the toner supply. A toner remover 126 may be located after the extractor unit to insure that all of the toner is removed from the belt prior to the belt leaving the extraction housing. Toner remover 126 may be a belt agitator that removes toner adhering to the belt by shaking the belt (shown as a wheel with spokes that shake the belt as the wheel is rotated), a vacuum source or any other device which results in a toner-free belt. After the toner remover, belt 102 continues its travels to take up roll housing 130 passing through a pair of rollers 129 to take up roll 132. Take up roll 132 is wound on take up roller 134, which is connected to a motor 136 which causes the take up roller to rotate in the direction indicated by arrow 133. Supply roller 107 and take up roller 134 must be properly tensioned to insure that the belt travels through the system in a known and controlled manner.

It is necessary to control the travel speed of the belt through the toner supply and delivery system 100 in order to insure that the proper amount of toner is supplied to the developing system. One of many ways to control the movement of the belt is to rotate the take up roll roller 134 at a constant speed when the electrophotographic machine is activated.

Other more accurate methods of controlling the speed of the belt and thus the toner supply include determining the amount of toner used by the developing system and insuring that the rate of supply is equal to the amount spent. For example, imaged pixels used to determine the amount of toner used by the developing system is taught in U.S. Pat. Nos. 5,204,689 and 5,349,377, which are assigned to the same assignee as the present invention and hereby incorporated by reference. ESS 29 is connected to motor 136 and activates the motor when toner use is indicated. The amount of toner 105 in each toner bubble 104 is known and it is relatively easy to index the belt movement to supply the amount of toner necessary to maintain a proper toner supply in the developer housing 80. A plurality of toner bubbles may be ruptured at the same time, depending upon the amount of toner in each bubble and the amount of toner delivery desired.

When supply roll 106 is empty, it can be cleanly and easily replaced since the toner supply is contained within sealed bubbles prior to its being delivered to the extracting unit. The complete toner supply housing can be replaced with a new toner supply housing or a new supply of toner can be added to the depleted toner supply housing. It is convenient to remove take up roll 132 when the toner supply is renewed. For the cleanest possible removal process, take-up roll housing 130 with take up roll 132 inside it should be removed rather than removing take up roll 132 from the take up roll housing. Of course, the take up roll 132 can be removed while the take up roll housing remains attached to the extractor unit, however some way of sealing the take up roll, such as a plastic bag, would be necessary so that any toner particles remaining on the take up roll are contained.

There are many different ways of configuring the toner storage and delivery system. For example, the extracting housing may be separate or integrally connected to the take up roll housing. When the take up roll housing is separate from the extractor housing, the extractor housing can remain connected to the developer housing 80 while the take up roll housing is replaced. When the take up roll housing is integrally connected to the extractor housing, both housings are replaced when the take up roll is replaced. Once a new supply roll is in place, a lead edge on the belt free of toner bubbles is threaded through the toner supply and delivery system and the developing process is ready to begin again.

When the toner supply housing and take up housing are connected, they can be replaced with a supply/take-up unit with the belt already connected between the supply and take up housings.

Figure 2:
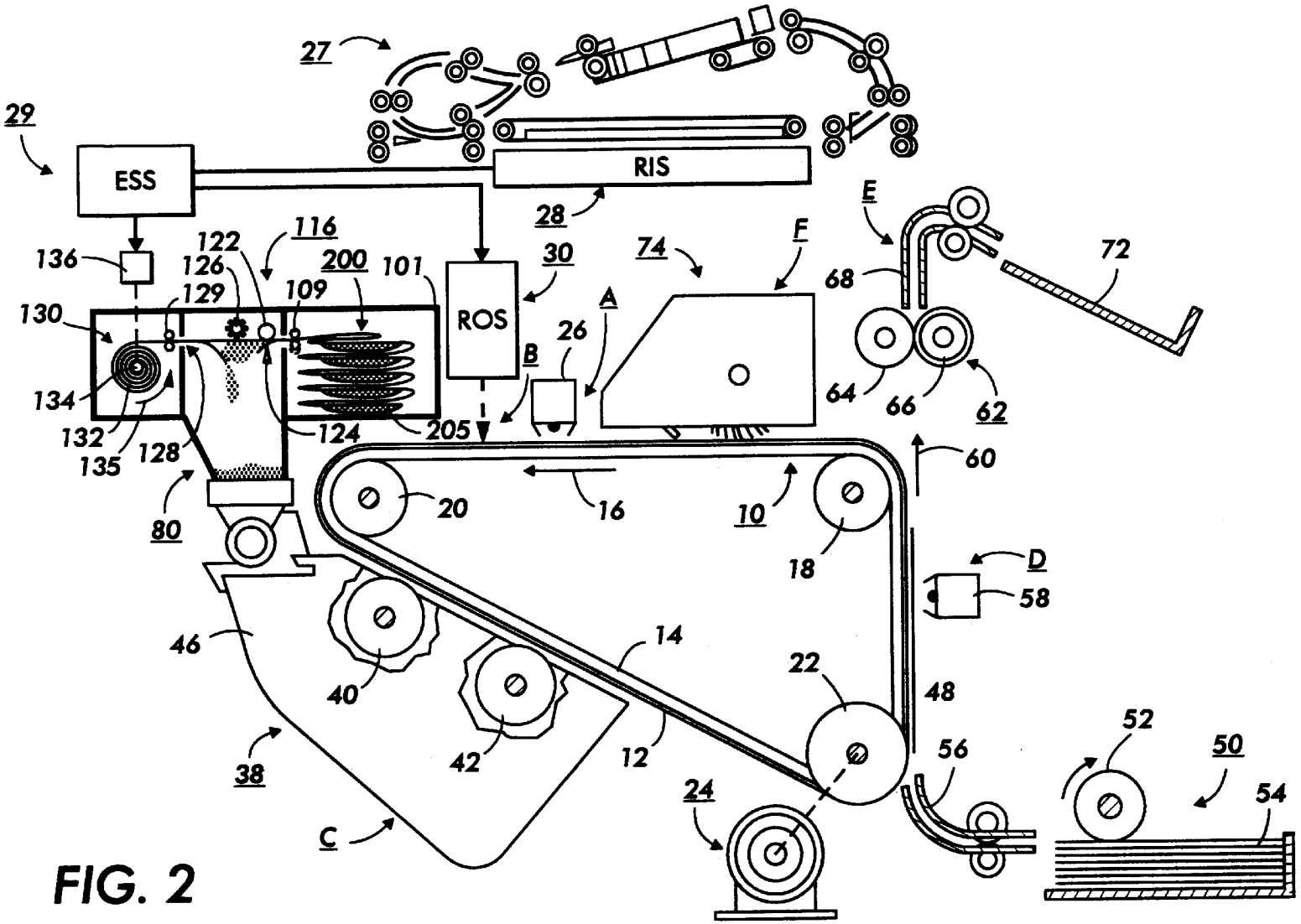
FIG. 2 is a perspective view of the toner pack supply system used in a second embodiment of the present invention

An alternative embodiment of the invention is shown in FIG. 2 in which toner supply housing 101 is attached to extractor housing 116. In this embodiment a larger sealed toner pack 200 filled with toner 205 is possible due to the fact that the toner supply housing and extractor housing are in one unit, an extractor housing being sealed from the rest of the electrostatographic machine being no longer necessary. A series of toner packs 200 are connected together so that when one toner pack is depleted of toner, another pack full of toner takes its place. The toner packs move from toner supply housing 101 through positioning rollers 109 to extractor housing 116. In this embodiment, extractor unit 124 is shown as a knife which slits open toner pack 200 as it passes through the extractor housing to the take up housing 130. Toner 205 falls into developer housing 80 as the toner pack 200 is opened. The depleted toner pack continues its travel past toner remover 126 to take up housing 130. Rollers 129 properly position and tension the depleted containers with respect to take up member 134 which rotates in the direction indicated by arrow 135 to form take up roll 132.

It is, therefore, apparent that there has been provided in accordance with the present invention, a method and apparatus for storing and delivering toner to a developing system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A method for storing and delivering toner to a developing system in a printing device comprising:

storing toner in a first container and a second container, the first and second containers being sealed containers;

connecting the first container and the second container with a connecting member;

placing the first container and the second container in a toner supply housing;

extracting toner from the first and second containers by rupturing the first and second containers;

delivering the extracted toner to the developing system;

moving the first and second containers from the toner supply housing to an extracting housing wherein the toner extracting occurs;

controlling the movement of the first and second containers with a controller based on the amount of toner used by the development system; and moving the first and second containers to a take up member after the toner extracting, the take up member being controlled by the controller.

2. A method as claimed in claim 1, further comprising:

spacing the toner supply housing from the extracting housing so that a non-sealed relationship exists between the toner supply housing and the extracting housing.

3. A method as claimed in claim 1, wherein the extracting step includes extracting toner from the first container and then extracting toner from the second container.

4. A method as claimed in claim 3, further comprising:

removing toner from the first and second containers with a toner removing member after the toner extracting.

5. A method as claimed in claim 4, wherein the toner removing step includes:

shaking the first and second containers with the toner removing member.

6. A method as claimed in claim 1, further comprising:

locating the first and second containers on the connecting member, the connecting member having a first end and a second end;

attaching the first end of the connecting member to a supply member in the toner supply housing;

passing the second end of the connecting member through the extractor housing and attaching it to the take up member; and moving the take up member so that the connecting member and the first and second containers move from the toner supply housing to the take up member.

7. An apparatus for storing and delivering toner to a developing system in an electrophotographic machine comprising:

a first container and a second container, each container being sealed with an amount of toner stored therein;

a connecting member connecting the first and second containers;

a toner supply housing for storing the first and second containers;

an extractor unit that extracts toner from the first and second containers, the extracted toner being delivered to the developing system a controller for controlling the amount of toner supplied to the extractor unit such that the toner is extracted sequentially from the first and second containers;

a take-up member which receives and stores the first and second containers after the toner has been extracted therefrom, wherein the controller is connected to the take up member, the controller controlling movement of the take-up member, which in turn causes the first and second container to travel past the extracting unit.

8. An apparatus as claimed in claim 7, wherein the first and second containers are made of a flexible material which is ruptured by the extractor unit.

9. An apparatus as claimed in claim 8, wherein the extractor unit includes a pressure member which ruptures the sealed containers.

10. An apparatus as claimed in claim 8, wherein the extractor unit includes a knife which cuts the sealed containers open.

11. An apparatus as claimed in claim 7, wherein the toner supply housing and extractor unit are spaced a distance from one another such that a non-sealed relationship exists between them.

12. An apparatus as claimed in claim 7, wherein the controller moves the take-up member based on the amount of toner used by the developing system.

13. An apparatus as claimed in claim 7, further comprising:

a toner removing member which removes toner from the first and second container as the first and second containers travel from the extractor unit to the take-up member.

14. An apparatus for storing and delivering toner to a developing system in an electrophotographic machine comprising:

a first container and a second container, each container being sealed with an amount of toner stored therein;

a connecting member connecting the first and second containers, the connecting member being a belt with a first end and a second end;

a toner supply housing for storing the first and second containers;

an extractor unit that extracts toner from the first and second containers, the extracted toner being delivered to the developing system, wherein the first and second containers are made of a flexible material which is ruptured by the extractor unit;

a controller for controlling the amount of toner supplied to the extractor unit such that the toner is extracted sequentially from the first and second containers;

a take-up member which receives and stores the first and second containers after the toner has been extracted therefrom, wherein the first belt end being threaded through the extractor unit and attached to the take-up member; and the second belt end being attached to a supply member in the supply housing, movement of the take-up member causing the belt to travel from the supply housing, through the extractor unit and to the take-up member.

* * * * *